US005283151A

United States Patent [19]

Santilli

[11] Patent Number: 5,283,151

[45] Date of Patent: Feb. 1, 1994

[54] METHOD FOR THE PREPARATION OF ELECTROSTATOGRAPHIC TONER OF CONTROLLED SHAPE BY EVAPORATIVE LIMITED COALESCENCE

[75] Inventor: Domenic Santilli, Webster, N.Y.

[73] Assignee: Eastman Kodak Company, Rochester, N.Y.

[21] Appl. No.: 890,060

[22] Filed: May 28, 1992

[51] Int. Cl.[5] ..... G03G 9/08

[52] U.S. Cl. ..... 430/137

[58] Field of Search ..... 430/106, 106.6, 109, 430/110, 137

[56] References Cited

U.S. PATENT DOCUMENTS

| | | | |
|---|---|---|---|
| 4,514,487 | 4/1985 | Kasuya et al. | 430/126 |
| 4,659,641 | 4/1987 | Mahalek et al. | 430/108 |
| 4,789,617 | 12/1988 | Arahara et al. | 430/137 |
| 4,833,060 | 5/1989 | Nair et al. | 430/110 |
| 4,835,084 | 5/1989 | Nair et al. | 430/137 |
| 4,965,131 | 10/1990 | Nair et al. | 430/137 |
| 5,180,649 | 1/1993 | Kukimoto et al. | 430/106.6 |

*Primary Examiner*—John Goodrow

*Attorney, Agent, or Firm*—Willard G. Montgomery

[57] ABSTRACT

A method is described for the preparation of electrostatographic toner particles which involves the use of carnauba wax for treating the surface of a pigment employed The method involves recrystallizing carnauba wax from its natural state by dissolution in ethyl acetate and cooling to precipitate needle like structures The structures so obtained are then added to a mixture comprising a pigment, a polymer material, a solvent and optionally a charge control agent which mixture serves as the organic phase in a limited coalescence process. The toner particles produced in accordance with this method are non spherical in nature and evidence excellent fluidity and anti-blocking properties.

18 Claims, No Drawings

METHOD FOR THE PREPARATION OF ELECTROSTATOGRAPHIC TONER OF CONTROLLED SHAPE BY EVAPORATIVE LIMITED COALESCENCE

FIELD OF THE INVENTION

This invention relates to a method for the preparation of polymeric powders suitable for use as electrostatographic toner, and more particularly, to a method for the preparation of toner particles of controlled shape in which carnauba wax is employed for controlling sphericity of the particles.

BACKGROUND OF THE INVENTION

Electrostatic toner polymer particles are commonly prepared by suspension polymerization in a process commonly referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble particulate suspension stabilizer and the size to which the solvent-polymer droplets are reduced by the agitation employed.

Suspension polymerization techniques of this type have been described in numerous patents pertaining to the preparation of electrostatographic toner particles because such techniques typically result in the formation of toner particles having a substantially uniform size and uniform size distribution. Representative suspension polymerization processes employed in toner preparation are described in U.S. Pat. Nos. 4,314,932, 4,360,611, 4,415,644, and 4,789,617.

U.S. Pat. No 4,789,617 is representative of the prior art in this field and describes a process for the preparation of electrostatographic toner particles by solution polymerization. This process involves dispersing a polymerizable monomer, a colorant and a low softening point compound in an aqueous medium heated to a temperature above the polymerization temperature to form particles of the monomer composition and then adding a water insoluble polymerization initiator to the aqueous medium to effect solution polymerization. This results in the formation of polymerization toners which are spherical in nature, of required fluidity, and evidence excellent anti-blocking characteristics and sharp particle size distribution. These toners contain large amounts of a low softening point compound having a softening point within the range of 40°-130° C. Examples of the low softening point compound employed are paraffins, waxes, low molecular weight polyolefins, modified waxes having an aromatic group, natural waxes, and long chain carboxylic acids having a long hydrocarbon chain including 12 or more carbon atoms. Among the waxes described are beeswax, carnauba wax and montan wax. The low softening point compounds employed are used in an amount ranging from 50–3000 parts by weight to 100 parts by weight of polymerizable monomer. The net result of this prior art technique is the production of spherical toner particles of sharp particle size distribution which evidence excellent fluidity and anti-blocking properties.

The shape of the toner particles prepared in accordance with the foregoing prior art technique and that of the aforementioned representative patents is generally spherical, especially when the size of the particles is smaller than 10 microns. This is of particular concern to those skilled in the art since it is also known that particle size and shape have a bearing upon the electrostatic toner transfer properties. Thus, for example, the transfer efficiency of toner particles has been found to improve as the sphericity of the particles is reduced Accordingly, workers in the art have long sought to modify the shape of the evaporative limited coalescence type toners independently of pigment or binder choice in order to enhance the transfer properties of the toner.

SUMMARY OF THE INVENTION

In accordance with the present invention, this end has been successfully attained by a novel process in which carnauba wax is introduced into the organic phase of the limited coalescence process in a limited amount. It has surprisingly been found that the use of this limited amount of this specific wax, i.e., carnauba wax, which is highly surface active in nature, results in the formation of non-spherical toner particles once the solvent is removed. The toner particle shape is controlled or modified by the limited amount of this specific wax independently of the toner polymer (resin, binder matrix) and optional pigment used to form the toner. Further, it has been determined that the degree of non-sphericity is directly related to the wax concentration The resulting non-spherical shape of the carnauba wax containing particles enhances electrostatic transfer efficiency of the toner particles from the developed electrostatic latent image to a receiver such as plain paper. Also, since carnauba wax is an essentially colorless substance, it does not affect the hue of toners in which it is included with the toner pigment.

Viewed from one aspect, the present invention is directed to a method for the preparation of electrostatographic toner. The method comprises the steps of dissolving carnauba wax in ethyl acetate heated to a temperature of at least 75° C. and cooling the solution, so resulting in the precipitation of the wax in the form of very fine needles a few microns in length; recovering the wax needles and mixing therewith a polymer material, a solvent and optionally a pigment and a charge control agent to form an organic phase; dispersing the organic phase in an aqueous phase comprising a particulate stabilizer and homogenizing the mixture; and evaporating the solvent and washing and drying the resultant product.

Viewed from another aspect, the present invention is directed to a process for preparing electrostatographic toner by dispersing an organic phase in an aqueous phase to yield a layer of particulate suspension stabilizer on the surface of a polymer The improvement in the process comprises adding carnauba wax in ethyl acetate to a polymer material, a pigment and optionally a charge control agent to form the organic phase in the aforementioned limited coalescence process.

These and other features and advantages of the invention will be better understood taken in conjunction with the following detailed description and claims.

DETAILED DESCRIPTION OF THE INVENTION

In accordance with the present invention, a solution of carnauba wax in ethyl acetate is prepared. Carnauba wax is a natural product extracted from the leaves of the Brazilian palm tree. It is a hard wax normally found in large brittle chunks which must be converted into a form useful in the practice of the invention. The first step then in the process involves dissolving the wax in its natural form in ethyl acetate heated to a temperature of about 75° C. Following this, the solution is cooled and in the cooling process the wax precipitates in the form of very fine needles of a few microns in length.

The next step in the inventive process involves mixing the wax needles so obtained with a pigment, a polymer material (binder, resin, toner matrix), ethyl acetate and optionally a charge control agent to form an organic phase in which the pigment concentration ranges from about 2.0 to 30.0%, by weight, based on the weight of the total solids present, and the pigment to wax ratio ranges from about 1:1 to 1:0.05. The charge control agent is employed in an amount ranging from 0 to 10 parts per hundred, based on the total weight of solids present, with a preferred range from 0.2 to 3.0 parts per hundred. The ethyl acetate solvent is employed in an amount ranging from about 250 to 900% based upon the total weight of solids present This mixture is permitted to stir overnight and then dispersed in an aqueous phase comprising a particulate stabilizer.

The particulate stabilizer selected for use herein may be selected from among highly cross-linked polymeric latex materials of the type described in U.S. Pat. Nos. 4,965,131 which issued on Oct. 23, 1990 to M. Nair et al., or $SiO_2$.

These stabilizers typically have colloidal dimensions. The size and concentration of these stabilizers controls and predetermines the size of the final toner particles. In other words, the smaller the size and/or the higher the concentration of such particles, the smaller the size of the final toner particles. The particulate stabilizer is generally used in an amount ranging from about 1–15 parts, by weight, of the final product.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. It will be appreciated by those skilled in the art that the promoter is required only when silica is employed as the stabilizing agent. When latex is employed for this purpose, the hydrophobic/hydrophilic characteristics are provided by the polymers employed. Typical of such promoters are sulfonated polystyrenes, alginates, carboxy methyl cellulose, tetramethyl ammonium hydroxide or chloride, diethylaminoethylmethacrylate, water soluble complex resinous amine condensation products such as the water soluble condensation products of diethanol amine and adipic acid, water soluble condensation products of ethylene oxide, urea and formaldehyde and polyethyleneimine. Also effective for this purpose are gelatin, casein, albumin, gluten and the like or nonionic materials such as methoxycellulose. The promoter is generally used in an amount from about 0.2 to about 0.6 parts per 100 parts of aqueous solution.

Various additives generally present in electrostatographic toner may be added to the polymer prior to dissolution in the solvent or in the dissolution step itself, such as charge control agents. Suitable charge control agents are disclosed for example in U.S. Pat. Nos. 3,893,935; 4,079,014; 4,323,634 and British Patent Nos. 1,501,085 and 1,420,839. Charge control agents are generally employed in small quantities such as from about 0 to about 10 parts per hundred based upon the weight of the final toner product, and preferably from about 0.2 to about 3.0 parts per hundred based on the weight of the toner.

The resultant mixture is then subjected to mixing and homogenization. In this process, the particulate stabilizer forms an interface between the organic globules in the organic phase and the aqueous phase. Due to the high surface area associated with small particles, the coverage by the particulate stabilizer is not complete. Coalescence continues until the surface is completely covered by the particulate stabilizer. Thereafter, no further growth of the particles occurs. Accordingly, the amount of the particulate stabilizer is inversely proportional to the size of the toner obtained. The relationship between the aqueous phase and the organic phase, by volume, may range from 1.5:1 to approximately 9:1. This indicates that the organic phase is typically present in an amount from about 10% to 40% of the total homogenized volume.

Following the homogenization treatment, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polyfluoroolefins, such as polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methyl acrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as $TiO_2$, carbon black and the like. Typical of the phthalocyanine pigments are copper phthalocyanine, mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red CL69 and hansa yellow; and metallized pigments such as azo yellow and permanent red. The carbon black may be any of the known types such as channel black, furnace black, acetylene black, thermal black, lamp black and aniline black. The pigments are employed in an amount sufficient ti give a content thereof in the toner from about 1 to 40%, by weight, based upon the weight of the toner, and preferably within the range of 4 to 20%, by weight.

The hard wax chosen for use in the practice of the present invention is carnauba wax, a naturally occurring wax which has a melting point of 83° C. The wax is available from commercial sources and is employed in an amount ranging from 0.1% to 40%, by weight, based upon the weight of the final toner. Studies have revealed that the use of greater than 40 weight per cent results in the formation of a mixture which is too viscous and yields a brittle product whereas the lower limit of 0.1% is dictated by practical considerations.

The invention will be more fully understood by reference to the following exemplary embodiment which is set forth solely for purposes of exposition and is not to be construed as limiting.

EXAMPLE 1

In a pint jar, 200 milliliters of ⅛" stainless steel media were placed together with 15 grams of carbon black pigment (REGAL 300 manufactured by Cabot Corp.), 7.5 grams of butyl acetate-styrene copolymer (PICCOTONER 1221 manufactured by Hercules Powder Co.), 2 2.5 grams of 33% carnauba wax in ethyl acetate and 140.0 grams of ethyl acetate. The wax had been dissolved in ethyl acetate at about 75° C. and recovered in the form of fine needles as a precipitate by cooling the resultant solution and then redissolved in ethyl acetate to form the 33% solution.

The resultant mixture was then milled for 3 days to yield a concentrate. Next, 74.0 grams of the concentrate was added to 426.0 grams of ethyl acetate containing 88.0 grams of a butyl acetate-styrene copolymer (PICCOTONER 1221) in solution. This mixture was comprised of 6% pigment, 3.0% carnauba wax and 91% binder copolymer and comprised the organic phase in this evaporative limited coalescence process. The organic phase was then added to an aqueous phase comprising 1500 milliliters of a buffer solution having a pH of 10 containing 54.0 grams of a latex dispersion comprising 3% solids in water. This mixture was the subjected to very high shear using a Polytron sold by Brinkman followed by a Microfluidizer. Upon exiting, the solvent was removed from the particles so formed by stirring overnight at room temperature in an open container to yield elongate particles which were of the order of 7 microns volume average and entirely non. spherical.

EXAMPLE 2

The procedure of Example 1 was repeated with the exception that the carnauba wax was omitted from the mixture. The resultant particles were completely spherical in nature and were approximately 7 microns in size.

EXAMPLE 3

The procedure of example 1 was repeated with the exception that the carbon black pigment was replaced by NOVAPERM YELLOW HR 11-1400 manufactured by Hoechst Celanese Co. The resultant particles were totally non-spherical in nature and approximately 7 microns in size.

EXAMPLE 4

The procedure of example 1 was repeated with the exception that the carbon black pigment was replaced with the cyan pigment bridged aluminum phthalocyanine. The resultant toner particles were totally non-spherical and 7 microns in size.

EXAMPLE 5

The procedure of example 1 was repeated with the exception that the pigment was omitted. The resultant toner particles were found to be entirely non-spherical in nature.

EXAMPLE 6

The procedure of example 5 was repeated with the exception that the carnauba wax was omitted. The resultant toner particles were perfectly spherical in nature.

While the invention has been described in detail with reference to certain preferred embodiments, it will be understood that variations may be made by one skilled in the art without departing from the spirit and scope of the invention. Thus, for example, different polymer compositions and pigments may be utilized throughout the examples for those employed.

What is claimed is:

1. A method for the preparation of electrostatographic toner comprising the steps of:

(a) mixing carnauba wax in a first solvent heated to a temperature sufficient to dissolve the wax and cooling the resultant solution, so resulting in the precipitation of the wax in the form of fine needle-like structures;

(b) mixing the wax needles with a polymer material, a pigment, a second solvent and optionally a charge control agent to form an organic phase;

(c) dispersing the organic phase in an aqueous phase comprising a promoter and a particulate stabilizer and homogenizing the resultant mixture; and (d) evaporating the second solvent and washing and drying the resultant product.

2. The method of claim 1 wherein the first solvent and the second solvent are the same.

3. The method of claim 1 wherein the first and second solvents are ethyl acetate.

4. The method of claim 1 wherein the pigment to wax ratio ranges from 1:1 to 1:0.05.

5. The method of claim I wherein the particulate stabilizer is selected from the group consisting of highly cross-linked latex particles and $SiO_2$.

6. The method of claim 1 wherein the polymer material is butyl acrylate-styrene copolymer.

7. The method of claim 1 wherein the pigment employed comprises from 2.0 to 30.0%, by weight, of total solids present including wax.

8. The method of claim 1 wherein the pigment employed comprises carbon black.

9. The method of claim 1 wherein the pigment employed comprises bridged aluminum phthalocyanine.

10. In a method for preparing electrostatographic toner by dispersing an organic phase in an aqueous phase to yield a layer of particulate stabilizer on the surface of a polymer, the improvement which comprises adding carnauba wax in a solvent to a polymer material, a pigment and optionally a charge control agent to form an organic phase for dispersing in the aqueous phase.

11. The method of claim 10 wherein the solvent is ethyl acetate.

12. The method of claim 10 wherein the polymer is butyl acrylate-styrene copolymer.

13. The method of claim 10 wherein the pigment to carnauba wax ration ranges from about 1:1 to 1:0.05.

14. The method of claim 10 wherein the pigment employed comprises carbon black.

15. The method of claim 10 wherein the pigment employed comprises bridged aluminum phthalocyanine.

16. Electrostatographic toner prepared in accordance with the method of claim 1.

17. Electrostatographic toner prepared in accordance with the method of claim 10.

18. Electrostatographic toner in accordance with claims 16 or 17 comprising carbon black and being non-spherical in shape.

* * * * *